United States Patent [19]

Flocke et al.

[11] 4,347,912

[45] Sep. 7, 1982

[54] AIRBORNE-SOUND-ABSORBING WALL OR CEILING PANELING

[75] Inventors: Heinz A. Flocke; Udo Weuster, both of Weinheim, Fed. Rep. of Germany

[73] Assignee: Carl Freudenberg, Hohnerweg, Fed. Rep. of Germany

[21] Appl. No.: 190,696

[22] Filed: Sep. 25, 1980

[30] Foreign Application Priority Data

Nov. 26, 1979 [DE] Fed. Rep. of Germany ..... 2947607

[51] Int. Cl.[3] ..... E04B 1/82; B32B 3/26; B32B 27/04

[52] U.S. Cl. ..... 181/286; 55/145; 181/290; 428/138; 428/198

[58] Field of Search ..... 181/286, 290, 284; 55/145; 428/131, 138, 195, 198, 209, 284, 285; 156/252, 291

[56] References Cited

U.S. PATENT DOCUMENTS 2,668,348 2/1954 Hubbell ..... 428/198 X 4,111,081 9/1978 Hilliard et al. ..... 181/290

*Primary Examiner*—Donald A. Griffin

*Assistant Examiner*—Thomas H. Tarcza

*Attorney, Agent, or Firm*—Sprung, Horn, Kramer & Woods

[57] ABSTRACT

Airborne-sound-absorbing wall or ceiling paneling comprises a perforated plate having a hole-area proportion L and a nonwoven fabric bonded thereto by a discontinuously distributed adhesive layer. The nonwoven fabric has an open-area proportion N and an air flow resistance $W_v$ in the zones free of adhesive, said perforated plate being mountable at a spacing from a wall or ceiling that is large in relation to the thickness of the nonwoven fabric. The paneling has a total air flow resistance W and the adhesive layer is applied to the nonwoven fabric in the form of a fine pattern. The proportion per unit area of the nonwoven fabric which is not covered with adhesive is approximately equal to the ratio of its air flow resistance $W_v$ and the hole-area proportion L divided by the desired total air flow resistance W.

11 Claims, 8 Drawing Figures

AIRBORNE-SOUND-ABSORBING WALL OR CEILING PANELING

BACKGROUND OF THE INVENTION

The invention relates to airborne-sound-absorbing wall or ceiling paneling consisting of a perforated plate having a hole-area proportion L and, bonded thereto by means of a discontinuously distributed adhesive layer, a nonwoven fabric having an open-area proportion N and an air flow resistance $W_v$ in the zones free of adhesive, said perforated plate being mounted at a spacing from the wall or ceiling that is large in relation to the thickness of the nonwoven fabric, and said paneling having a total air flow resistance W.

The physical bases for the design of paneling of this type are dealt with in detail in "Wirtschaftliche Gestaltung von Schallschluckdecken" (Economic design of sound-absorbing ceilings), by G. Kurtze, which appeared in VDI-Z 119 (1977), No. 24, p. 1193 et seq. According to that paper, the use of a thin nonwoven will result in broad-band, effective sound attenuation if it can be rigidly disposed at a spacing from the wall of the room to be soundproofed that is large in relation to the thickness of the nonwoven. The effect so utilized is illustrated by an example which relates to a metal coffer 70 mm deep which on its face is covered by a perforated metal plate having a thin nonwoven fabric bonded directly to its underside. In bonding the two parts together, care must be taken to assure that the air flow resistance of the nonwoven layer is not increased in an undefined manner. For this reason, the adhesive must not be applied to the nonwoven fabric, which complicates the bonding operation. Another drawback is that relatively narrow limits are imposed on the perforations of the metal plate with respect to type and to proportion of the hole area, and these often make it impossible to design the side exposed to view as desired.

SUMMARY OF THE INVENTION

The invention has as its object to improve such paneling with a view to simplifying its manufacture, a further object being to provide greater esthetic freedom in designing the side exposed to view.

In accordance with the invention, this object is accomplished in that the adhesive layer is applied to the nonwoven fabric in the form of a pattern and that the proportion per unit area of the nonwoven fabric which is not covered by the adhesive layer is as nearly as possible equal to the ratio of its air flow resistance $W_v$ and the hole-area proportion L, divided by the desired total air flow resistance W. It should be noted that deviations from said ratio may be within a range of $\pm 30\%$ and still be within the scope of the invention.

The pattern in which the discontinuous adhesive layer is applied to the nonwoven fabric may be produced by various methods, for example, by conventional printing or spraying methods when a liquid adhesive is used, or by a scattering method when a powdered, dry adhesive is used. The polymeric materials which are suited for use as adhesives may be conventional adhesives, such as adhesives from the group of thermoplastics, which are dissolved in a solvent or suspended in a suspension liquid. Through judicious adjustment of the viscosity, the penetration of the adhesive into the nonwoven fabric during and after its application can be maintained at a predetermined specific ratio. After solidification, this will result in an additional stiffening of the nonwoven fabric.

The adhesive may also be one of the polymeric materials which when applied in liquid form by one of the methods mentioned above are converted during the ensuing drying to the B stage, that is to say, to a chemically procrosslinked stage. These polymeric materials include the polyester resins. When they are then reheated, they develop considerable adhesive power which through the accompanying complete cure results in insoluble solid compounds. Such adhesives therefore lend themselves particularly well to applications where the paneling may be exposed to elevated temperatures in normal use.

In accordance with the invention, it is contemplated that the proportion per unit area of the nonwoven fabric which is not covered by the adhesive layer be as nearly as possible equal to the ratio of its air flow resistance $W_v$ in the zones not covered by the adhesive layer and the hole-area proportion L, divided by the desired total air flow resistance W. Paneling intended for the damping of airborne sound will have optimum acoustical effectiveness if the air flow resistance W is 800 $Nsm^{-3}$. When an optimum design is sought, this value may be inserted as a constant in the term of the formula proposed in accordance with the invention. As hole-area and open-area proportions, respectively, of the perforated metal plate and the nonwoven fabric, the relative proportions of the total area are inserted or obtained. The air flow resistance $W_v$ of the uncoated nonwoven fabric is a physical quantity which can be determined by laboratory measurement.

The adhesive applied to the nonwoven fabric in the form of a pattern will form a permanent bond between the nonwoven fabric and the perforated metal plate. It further serves to prevent the nonwoven fabric from being entrained by the air motion due to the alternating sound pressure acting upon it. Apart from a rigid arrangement of the individual fibers, it is therefore desirable that the existing open-pore volume of the uncoated nonwoven fabric be impaired as little as possible. The pattern selected will therefore consistently have a very fine structure which may be composed of substantially circular and/or elongated partial layers as desired. The individual partial layers may be applied to the nonwoven fabric independently of one another. They may intersect or overlap one another or be associated with one another in any desired continually varying random pattern. All that matters is that they be correlated as taught. Accordingly, it is merely by way of example and as a guide that it is pointed out that a particularly advantageous width of the partial layers is 0.1 to 3 mm, with the thickness of the nonwoven fabric used ranging from 0.1 to 0.5 mm. Adhering to these ranges has been found advantageous in equipping conventional ceiling coffers in the manner claimed herein.

The portions of the nonwoven fabric directly covered with adhesive do not themselves have any sound-insulating properties. However, these portions may be used to advantage to prevent fiber motion in the other portions, by filling the pores and interstices there present in whole or in part with adhesive. When this is done with a liquid adhesive compound, for example, one based on a hot-melt adhesive, then it will completely envelope the individual fibers of the nonwoven fabric in proximity to the partial layers, thus providing optimum immobilization. Further improvements can be achieved by making the partial layers particularly compact so that they have a weighting or stiffening effect on the nonwoven fabric, which may be accomplished, for example, by not only filling all pores completely but also having the surface of the nonwoven fabric surmounted in the manner of a relief. Of course, care must then be taken that the nonwoven fabric is not spaced from the perforated metal plate in the area of the adhesive-coated zones. An additional enlargement of the mass may be secured by admixing with the printing paste used an additional filler, such as a mineral or metal powder. Finally, with a view to covering individual holes in the perforated metal plate which for esthetic reasons have been made especially large, it has been found advantageous to imprint the adhesive in the form of narrow strips onto the nonwoven fabric, which when placed in a parallel or overlapping manner will then bridge the holes. Even such extreme embodiments can be realized with optimum effectiveness when the correlation claimed in accordance with the invention is observed.

The nonwoven fabrics used must satisfy certain conditions to be within the spirit of the present invention. Particularly well suited are nonwoven fabrics made of mineral, synthetic and/or natural fibers, a fiber diameter of from 6 to 62 μm being preferred. The nonwoven fabrics should have pronounced uniformity with respect to both the reciprocal arrangement of the individual fibers and their overall arrangement. This is why nonwoven fabrics are preferably used which have been produced by the wet-bonding technique. However, other nonwovens may, of course, also be used, and possibly even woven fabrics.

The perforated plate may be made of a metallic and/or mineral material. A metallic plate will be very sturdy and also heavy while a mineral plate will have great rigidity but may be adversely affected by humidity. It will therefore be necessary to take the particular circumstances in consideration in each individual case.

BRIEF DESCRIPTION OF THE DRAWINGS

The present invention will be explained in more detail with reference to the accompanying drawings, which serve to illustrate the invention, wherein.

DETAILED DESCRIPTION OF THE INVENTION

Figure 1:
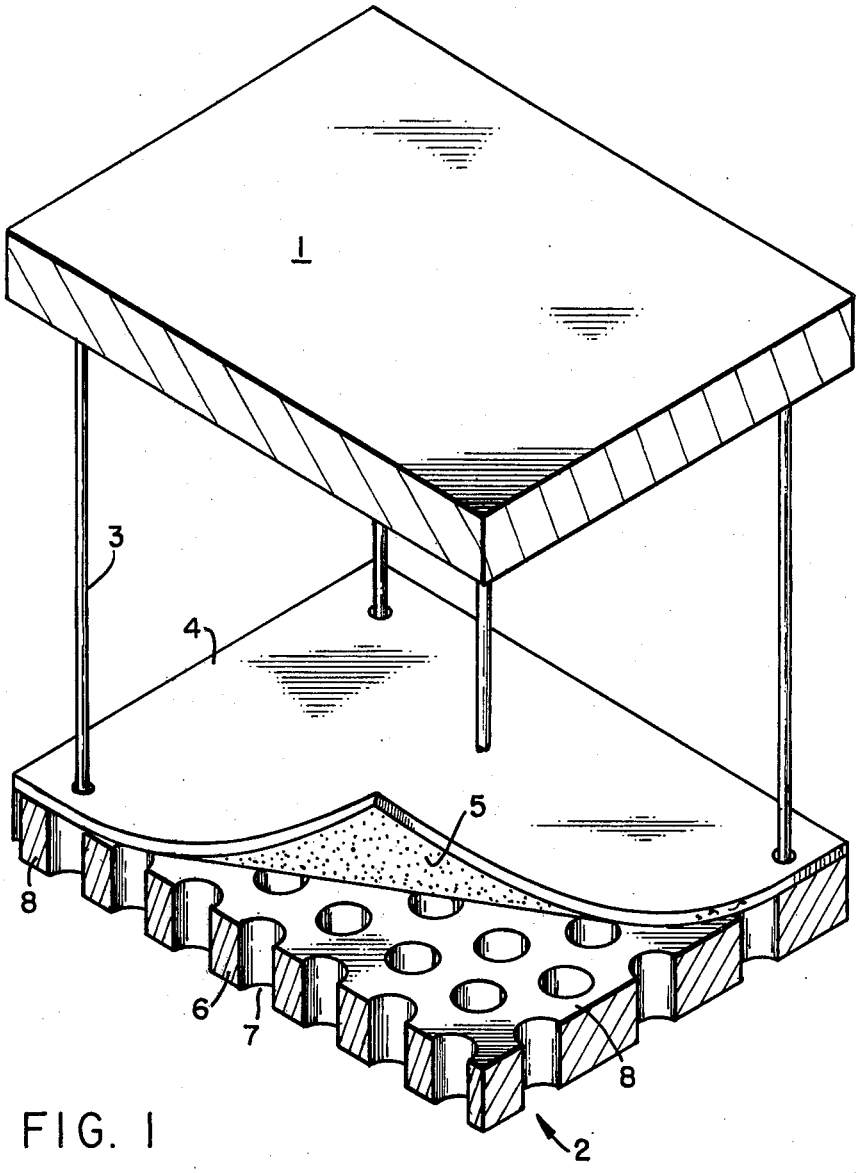
FIG. 1 is a perspective view of a section of the airborne-sound-absorbing paneling mounted under a ceiling, in accordance with the invention, with the nonwoven partially lifted from the surface.

FIG. 1 shows a partial view of an airborne-sound-absorbing panel 2 which is suspended from a ceiling 1 by means of rods 3. These rods are formed of steel wire having a diameter of 3 mm and are 200 mm long. Both ends are provided with undercuts, not shown, which are engaged into appropriately formed recesses in the ceiling and in the sound-absorbing panel to maintain the panel 2 in the position shown.

The airborne-sound-absorbing panel 2 consists of a perforated plate 6 and a nonwoven fabric 4 bonded to the top thereof by the use of a discontinuous adhesive layer 5.

The perforated plate 6 is made of a gypsum and is surfaced with covering layers of paper. It is provided with a body portion 8 and uniformly spaced perforations 7 which are about 6 mm in diameter. The hole-area proportion of the perforated plate 6 thus is 20%.

With an air flow resistance $W_v$ of 110 $Nsm^{-3}$, the nonwoven 4 bonded to the perforated plate would have a weight of 44 $g/m^2$ and a thickness of 0.2 mm. The fibers of the nonwoven are bonded to one another by a chemically crosslinked bonding agent, and the nonwoven of open-pore structure has a paperlike stiff hand.

The underside of the nonwoven 4 is bonded to the perforated plate 6 through a discontinuously distributed thermoplastic adhesive layer 5. The partial layers of the adhesive layer are made of polyethylene, have a constant diameter of 1 mm, and are spaced apart a constant and uniform 1.6 mm.

The nonwoven and the perforated plate are bonded to each other through thermal activation of the adhesive layer 5. Activation is effected in a heated chamber in which the two parts are pressed against each other and heated to a temperature of about 160° C. After the cooling which follows, the two parts firmly adhere to each other. The partial layers disposed in the area of the perforations 7 of the plate do not undergo any appreciable change of shape.

FIGS. 2 to 7 show different designs of the adhesive layer 5.

Figure 2:
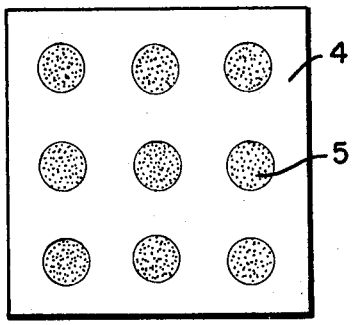
FIGS. 2 to 7 show examples of patterns for the formation of the partial layers from the adhesive according to the invention.

FIG. 2 shows an embodiment in which the partial layers are bounded by a circle and disposed on a square base grid. In such an embodiment, the reciprocal spacings of facing partial layers are different.

Figure 3:
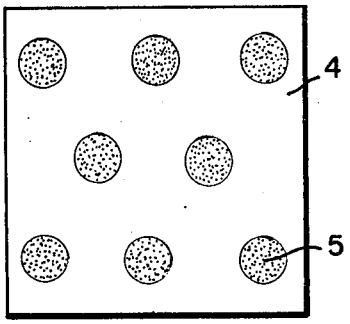

Shown in FIG. 3 is an embodiment in which the partial layers are disposed on a grid having the form of an equilateral triangle. In this case, all reciprocal spacings of the partial layers from one another are identical. In this case, too, the partial layers have a completely closed surface.

Figure 4:
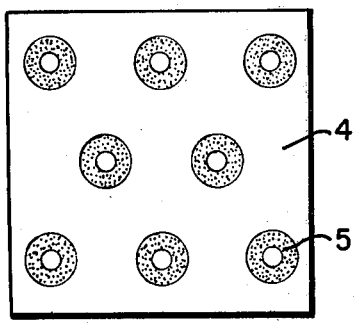

Partial layers according to FIG. 4 are circular and are also disposed on a grid having the form of an equilateral triangle.

Figure 5:
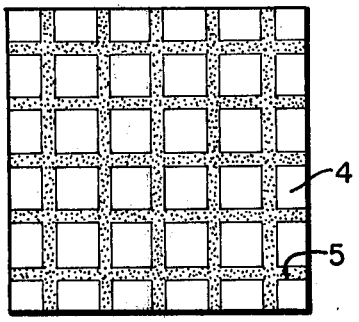

The partial layers according to FIG. 5 are formed by uniformly spaced strips intersecting at right angles.

Figure 6:
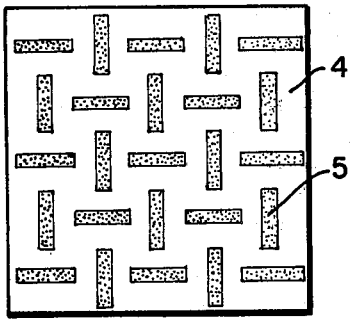

FIG. 6 shows an embodiment in which the partial layers are of elongated design and associated with one another in a broken pattern.

Figure 7:
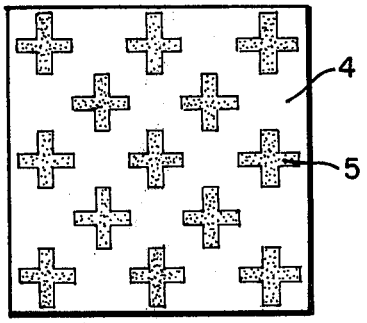

The partial layers according to FIG. 7 have an intersecting, unbroken pattern.

In addition to the embodiments illustrated, patterns are possible in which the partial layers are associated with one another in an irregular pattern, for example, in a statistical distribution. Hybrid forms are possible in which intersecting strips supplemented with dots or shorter stripes extend over the entire width of the nonwoven, associated with the elongated strips in a regular or irregular pattern.

Figure 8:
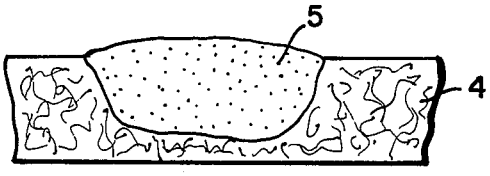
FIG. 8 is a section through the nonwoven in the vicinity of a partial layer according to the invention.

FIG. 8, which shows a longitudinal section through a nonwoven in the vicinity of a partial layer, is intended to demonstrate that the adhesive is not disposed solely on the surface of the nonwoven but that at least following thermal activation a portion of the interstices of the nonwoven in proximity to the partial layer is filled with adhesive. The fibers of the nonwoven thus undergo additional binding which has a stiffening effect and enhances sound absorption.

EXAMPLE 1

An uncoated nonwoven fabric having an air flow resistance $W_v$ of 140 $Nsm^{-3}$ was used. It had a weight of 44 g/m$^2$ and a thickness of 0.2 mm. It had been produced by the wet-bonding technique from a mixture of 70% cellulose fibers of an average length of 3 mm and 30% glass fibers of a length of 5 mm. Reinforcement was effected by means of a bonding agent.

The nonwoven fabric had a paperlike stiff handle and an open-pore structure. Its composition was as follows:

Fiber: 58%

Bonding agent:

Acrylate: 14%

PVC: 4%

Flameproofing agent, pigments, other additives: 24%

Also used was an esthetically designed perforated aluminum plate. It had circular holes whose centers were located on an equilateral triangle with a uniform center-to-center distance of 0.6 cm. These holes had a diameter of 3 mm each, and their area therefore represented 20% of the total area of the perforated plate, which corresponds to a hole-area proportion L of 0.2.

The problem to be solved is to develop a formula for the distribution of the adhesive layer on the nonwoven fabric which permits simple lining of the perforated plate while assuring optimum acoustic effectiveness.

Allowing for the term of the formula given herein and for the known optimum air flow resistance W=800 $Nsm^{-3}$ of an arrangement for the absorption of airborne sound, the relative open-area proportion N of the nonwoven fabric is $$N = \frac{W_v}{L \times W} = \frac{140\ Nsm^{-3}}{0.2 \times 800\ Nsm^{-3}} = 0.875$$

Accordingly, H, the proportion per unit area of the nonwoven fabric which is covered by the adhesive layer is $$H = 1 - N = 0.125.$$

Optimum acoustic effectiveness is secured only when that proportion of the area of the nonwoven fabric (H) is covered with an adhesive layer distributed in a fine pattern. The nature of the pattern as such is of less importance. With the thickness of the nonwoven fabric ranging from 0.1 to 0.5 mm, the width of elongated partial layers should be between 0.1 and 3 mm, and the diameter of area-covering circular partial layers, between 0.2 and 2 mm.

Simplified, the center-to-center distances of the partial layers in the case of the most often repeated patterns may be computed also with the aid of a formula. For example, in the case of circular and noncircular partial layers (or holes in the perforated plates) in a regular or irregular grid, in accordance with $$a = \sqrt{\frac{1}{n}}$$

or in the case of partial layers in the form of unbroken lines extending parallel to one another, $$a_1 = \frac{1}{n_1}.$$

wherein:

a=Center-to-center distance;

$a_1$=midpoint-to-midpoint distance;

n=number per unit area; and $n_1$=number per unit length.

EXAMPLE 1a

With the aid of the term $a=\sqrt{(1/n)}$ and allowing for the further limiting conditions, a diameter d=0.4 mm is selected for an adhesive-application pattern of regularly recurring circular areas. For the regularly recurring circular areas, the relation $$n = \frac{H}{\frac{\pi}{4} \cdot d^2}$$

holds.

For a covered relative area proportion H=0.125, the center-to-center distance for the grid thus is a=1 mm.

EXAMPLE 1b

With the aid of the term $a_1=(1/n_1)$ and allowing for the further limiting conditions, a width b=1 mm is selected for a pattern of partial layers in the form of straight lines extending parallel to one another. For these partial layers, the relation $$n_1 = (H/b)$$

holds.

For a relative area proportion H=0.125, the midpoint-to-midpoint distance thus is $a_1$=8 mm.

Both patterns were applied by imprinting them onto the nonwoven fabric by the use of a contact adhesive consisting of a self-adhesive thermoplastic material. The adhesive was applied in such a way that it penetrated into the nonwoven fabric to the extent of one-third of its thickness. After imprinting, the nonwoven fabric had a weight of 66 g/m$^2$, and the partial layers were projecting from 0.1 to 0.3 mm above its surface.

From these nonwoven fabrics, pieces were cut to the size of the perforated plate, applied to its underside with the adhesive layer, and pressed onto it.

It will be appreciated that the instant specification and claims are set forth by way of illustration and not limitation, and that various changes and modifications may be made without departing from the spirit and scope of the present invention.

What is claimed is:

1. Airborne-sound-absorbing wall or ceiling paneling comprising: a perforated plate having a hole-area proportion L and a nonwoven fabric bonded thereto by a discontinuously distributed adhesive layer and having an open-area proportion N and an air flow resistance $W_v$ in the zones free of adhesive, said perforated plate being mountable at a spacing from a wall or ceiling that is large in relation to the thickness of the nonwoven fabric and said paneling having a total air flow resistance W, wherein the adhesive layer is applied to the nonwoven fabric in the form of a fine pattern composed of substantially annular, circular and/or elongated partial layers, wherein the thickness of the nonwoven fabric is from 0.1 to 0.5 mm and the partial layers have a width ranging from 0.1 to 3 mm and that the proportion per unit area of the nonwoven fabric which is not covered with adhesive is approximately equal to its air flow resistance $W_v$ divided by the hole-area proportion L times the desired total air flow resistance W.

2. Paneling according to claim 1, wherein the partial layers consist of a noncrosslinked or crosslinked polymeric material.

3. Paneling according to claim 2, wherein the interstices of the nonwoven fabric in proximity to the partial layers are filled at least partially with adhesive.

4. Paneling according to claim 1, wherein the nonwoven fabric is a reinforced nonwoven fabric made of mineral, synthetic and/or natural fibers.

5. Paneling according to claim 4, wherein the fibers have a diameter ranging from 6 to 62 μm.

6. Paneling according to claim 1, wherein the nonwoven fabric is a wet-bonded nonwoven fabric.

7. Paneling according to claim 1, wherein the perforated plate is made of a metallic and/or mineral material.

8. Paneling according to claim 5, wherein the nonwoven fabric is a wet-bonded nonwoven fabric and wherein the perforated plate is made of a metallic and/or mineral material.

9. In a method for the production of an airborne-sound-absorbing paneling including bonding a nonwoven fabric with a discontinuously distributed adhesive layer to a perforated plate and mounting same to a wall or ceiling at a distance that is large in relation to the thickness of the nonwoven fabric, the improvement comprising applying the discontinuous adhesive layer to the nonwoven fabric in a form of a fine pattern consisting of substantially circular annular and/or elongated partial layers, providing the nonwoven fabric with a thickness of 0.1 to 0.5 mm, the partial layer with a width of 0.1 to 3 mm and configuring the adhesive and nonwoven fabric so that the proportion per unit area of the nonwoven fabric which is not covered with adhesive is approximately equal to its air flow resistance $W_v$ divided by the hole-area proportion L times the desired total air flow resistance W, and the nonwoven fabric is applied to the perforated plate by activation of the adhesive layer.

10. The method according to claim 9, wherein the adhesive layer is applied in liquid form by printing or spraying.

11. The method according to claim 9, wherein the adhesive layer is applied in form of a powder by sprinkling.

* * * * *